US006083083A

United States Patent [19]

Nishimura

[11] Patent Number: 6,083,083

[45] **Date of Patent: *Jul. 4, 2000**

[54] SEPARATION TYPE GRINDING SURFACE PLATE AND GRINDING APPARATUS USING SAME

[75] Inventor: Takanobu Nishimura, Chigasaki, Japan

[73] Assignee: Kabushiki Kaisha Toshiba, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/732,250

[22] PCT Filed: Apr. 21, 1995

[86] PCT No.: PCT/JP95/00793

§ 371 Date: Oct. 21, 1996

§ 102(e) Date: Oct. 21, 1996

[87] PCT Pub. No.: WO95/29039

PCT Pub. Date: Nov. 2, 1995

[30] Foreign Application Priority Data

Apr. 22, 1994 [JP] Japan ..... 6-084490
Dec. 26, 1994 [JP] Japan ..... 6-323080

[51] Int. Cl.[7] ..... B24B 1/00

[52] U.S. Cl. ..... 451/41; 451/388; 451/288; 451/391; 451/494

[58] Field of Search ..... 451/388, 288, 451/285–289, 386, 391, 494, 493, 449, 41

[56] References Cited

U.S. PATENT DOCUMENTS 4,141,180 2/1979 Gill, Jr. et al. .

FOREIGN PATENT DOCUMENTS

3319328 A1 12/1983 Germany .
59-1158 1/1984 Japan .
59-41185 10/1984 Japan .
3-5413 12/1984 Japan .
3-73425 10/1985 Japan .
60-228070 11/1985 Japan .
61-241059 10/1986 Japan .
63-134166 6/1988 Japan .
4-13093 6/1989 Japan .
2-83171 3/1990 Japan .
2-116468 5/1990 Japan .
2-30827 7/1990 Japan .
4053682 2/1992 Japan .
4-206929 7/1992 Japan .

OTHER PUBLICATIONS

Patent Abstracts of Japan, vol. 16, No. 242, Jun. 1992.

*Primary Examiner*—Robert A. Rose
*Assistant Examiner*—George Nguyen
*Attorney, Agent, or Firm*—Finnegan, Henderson, Farabow, Garrett & Dunner, L.L.P.

[57] ABSTRACT

A separation type grinding or polishing (hereinafter "grinding") surface plate (11) comprises a surface plate body (12) connected to a drive of a grinding apparatus directly or through a water cooled jacket or the like, and a disk (13) for grinding which is adapted to rotate together with the surface plate body (12) and contact an article being ground directly or through an abrasive cloth (14). The disk (13) for grinding is detachably held on the surface plate body (12) by vacuum suction or magnetic forces. Accordingly, it is possible to ensure an accuracy in a cleaning operation of a surface plate, a replacing operation of an abrasive cloth or the like as well as labor saving and to prevent lowering of a grinding accuracy due to thermal deformation. The grinding apparatus comprises the above separation type grinding surface plate (11), a vacuum system (20) or a magnetic system for detachably holding the disk (13) for grinding on the surface plate body (12), a drive system (16) for driving and rotating the separation type grinding surface plate (11), and an abrasive liquid supplying means (24) for supplying an abrasive liquid to the disk (13) for grinding.

15 Claims, 3 Drawing Sheets

SEPARATION TYPE GRINDING SURFACE PLATE AND GRINDING APPARATUS USING SAME

TECHNICAL FIELD

The present invention relates to a separation type grinding or polishing (hereinafter "grinding") surface plate and a grinding apparatus using the same which are used to accurately polish semiconductor wafers and laser and optical prisms.

BACKGROUND ART

Conventionally, as a method for accurately grinding semiconductor wafers, laser and optical prisms, various types of glass plates and metal plates, polishing by means of free abrasive grains has been applied.

As a typical example of the grinding apparatus, single side polishing will be described. A grinding surface plate which has an abrasive cloth affixed to its surface is driven and rotated on a horizontal surface, and an article being ground, which is connected to another flat plate to be driven and rotated, is slidably contacted to its surface. At the time of slidable contact, an abrasive liquid (a slurry of abrasive particles and a polishing solution) is supplied between the abrasive cloth and the article being ground to perform grinding.

As shown in FIG. 7 and FIG. 8, a conventional grinding surface plate 1 is fixed with at least 50 bolts 5, as it is adopted not to be disassembled on a semipermanent basis, onto a water cooled jacket 4 which is fixed with bolts 3 to a drive shaft 2 connected to an unillustrated drive. After assembling as described above, the grinding surface plate 1 is finish worked to a required dimensional accuracy. The abrasive cloth is affixed to the surface of the above-described grinding surface plate 1.

Meanwhile, in the case of polishing a semiconductor wafer for example, an accurate ground surface is formed by at lease either of the formation of a soft chemical product on the surface of the semiconductor wafer and the mechanical grinding with abrasive grains. Therefore, the surface of the grinding surface plate has its temperature increased to about 25 to 50 K. And, it is necessary to clean the remained abrasives from the surface of the abrasive cloth and to retain the abrasive cloth at appropriate hardness in order to achieve the uniform grinding of the semiconductor wafer surface. Accordingly, the abrasive cloth is frequently replaced as daily management.

The above-described conventional grinding surface plate cannot be easily removed from the grinding apparatus, and if the grinding surface plate is removed from the grinding apparatus, it is then necessary to adjust a dimensional accuracy, so that the above-described abrasive cloth replacing operation is necessarily performed on the grinding apparatus placed in a clean room. Therefore, it is difficult to secure an affixing accuracy of the abrasive cloth, and labor and time are highly required. In addition, the replacing operation in the cleaning room involves a disadvantage of degrading a clean level in the clean room. Particularly, the semiconductor wafer is becoming larger from year to year, being in a situation of entering an era of changing from 4 to 5-inch wafers to 8-inch wafers. Therefore, the grinding surface plate necessarily tends to be made large, making it more difficult to replace the abrasive cloth.

In view of above, as described in, for example, Japanese Patent Publication No. Hei 2-30827 and Japanese Patent Laid-Open Publication No. Hei 4-206929, it is proposed to separably configure the grinding disk with the abrasive cloth affixed and the surface plate body which is connected to a drive, and the grinding disk is removed from the surface plate body in order to make the abrasive cloth replacing operation. The separation type grinding surface plate which is described in Japanese Patent Publication No. Hei 2-30827 and Japanese Patent Laid-Open Publication No. Hei 4-206929 has pins fixed to the surface plate body inserted into holes formed on the circumference of the grinding disk to mechanically fix the circumference of the grinding disk, thereby attaching the grinding disk to the surface plate body. Therefore, when the grinding disk is thermally expanded due to heat generated at the grinding operation, there was a disadvantage that the center and its periphery of the grinding disk are deformed to bulge due to a temperature gradient between the grinding disk and the surface plate body, a differential thermal expansion between the grinding disk and the surface plate body, and the mechanical fixing of the circumference of the grinding disk. This deformation of the grinding disk naturally causes degradation of the grinding accuracy.

As described above, the conventional separation type grinding surface plate can facilitate-the cleaning and abrasive cloth replacing operations, but has a disadvantage that the grinding accuracy is easily deteriorated due to the deformation of the grinding disk caused by heat at the grinding operation.

An object of the present invention is to provide a separation type grinding surface plate which has achieved to secure an accuracy and save labor in the surface plate cleaning operation and abrasive cloth replacing operation and prevented a grinding accuracy from being deteriorated by a thermal deformation, and to provide a grinding apparatus using the same.

DISCLOSURE OF THE INVENTION

A separation type grinding surface plate according to the present invention is characterized by comprising a surface plate body which has suction ports for vacuum suction formed substantially uniformly in multiple numbers and is connected to a drive for a grinding apparatus, and a disk for grinding which is rotatable together with the surface plate body, detachably held on the surface plate body by vacuum suction and contacted to an article being ground directly or through an abrasive cloth, wherein the disk for grinding is held on the surface plate body by a vacuum suction force which allows displacement in the face direction of the disk for grinding so that the deformation of the disk for grinding in its thickness direction retains an allowable range.

A grinding apparatus according to the present invention comprises a separation type grinding surface plate which has a surface plate body having multiple suction ports formed substantially uniformly and a disk for grinding which is rotatable together with the surface plate body and detachably held on the surface plate body by vacuum suction, a vacuum system which holds the disk for grinding on the surface plate body by a vacuum suction force which allows displacement in the face direction of the disk for grinding so that the deformation of the disk for grinding in its thickness direction retains the allowable range by the vacuum suction of the disk for grinding via the suction ports, a drive system which rotates and drives the separation type grinding surface plate via a drive shaft connected to the surface plate body, and an abrasive liquid supplying means which supplies an abrasive liquid onto the disk for grinding.

And, the grinding apparatus is characterized by having a gas supplying system which supplies a gas between the surface plate body and the disk for grinding to remove the disk for grinding from the surface plate body.

The separation type grinding surface plate according to the present invention achieves the separation of the surface plate body and the disk for grinding by detachably attaching the disk for grinding to the surface plate body by the vacuum suction. Thus, since the surface plate body and the disk for grinding can be separated, daily management operations for cleaning the surface plate and replacing the abrasive cloth can be performed after removing the disk for grinding which forms a ground surface subject to the management operations from the surface plate body. And, the disk for grinding can be made lightweight, so that transportation or the like can also be made easily. Accordingly, the above daily management operations can be made by an outside arrangement and, for example, the abrasive cloth replacing operation and the like can be mechanized. Thus, the abrasive cloth replacing operation or the like can be made with accuracy secured and its labor can be saved, allowing to improve the grinding accuracy and the working rate of the grinding apparatus.

And, in the separation type grinding surface plate according to the present invention, the vacuum suction which is applied as a method for mounting the disk for grinding on the surface plate body are low in fixing force in a horizontal direction, so that the disk for grinding can relatively freely expand in an expanding direction even when a difference in thermal expansion is caused between the surface plate body and the disk for grinding. In other words, the disk for grinding is held on the surface plate body by the vacuum suction force which is smaller than a stress that deformation of the disk for grinding in its thickness direction exceeds an allowable range, or the disk for grinding is held on the surface plate body by the vacuum suction force which allows the displacement in the face direction of the disk for grinding so that the deformation of the disk for grinding in its thickness direction retains the allowable range.

Thus, the disk for grinding can be prevented from being deformed thermally by enhancing the freedom of the disk for grinding to elongate in the expansion direction. On the other hand, in the case of the mechanical fixing with, for example, a pin, a cramp or the like, the elongation in the expansion direction is restrained, so that it is highly possible that the disk for grinding is deformed. Besides, the vacuum suction can fix a ceramics material which was generally hard to fix with metal, and the disk for grinding can be made of a ceramics-based material.

In the grinding apparatus according to the invention, since the above-described separation type grinding surface plate is used, it is possible to secure an accuracy and to save labor in the abrasive cloth replacing operation or the like, and to improve the operation rate of the apparatus. And, by additionally providing the gas supplying system allows to readily remove the disk for grinding from the surface plate body.

MODE FOR CARRYING OUT THE INVENTION

Now, the present invention will be described in detail in the form of embodiments.

Figure 1:
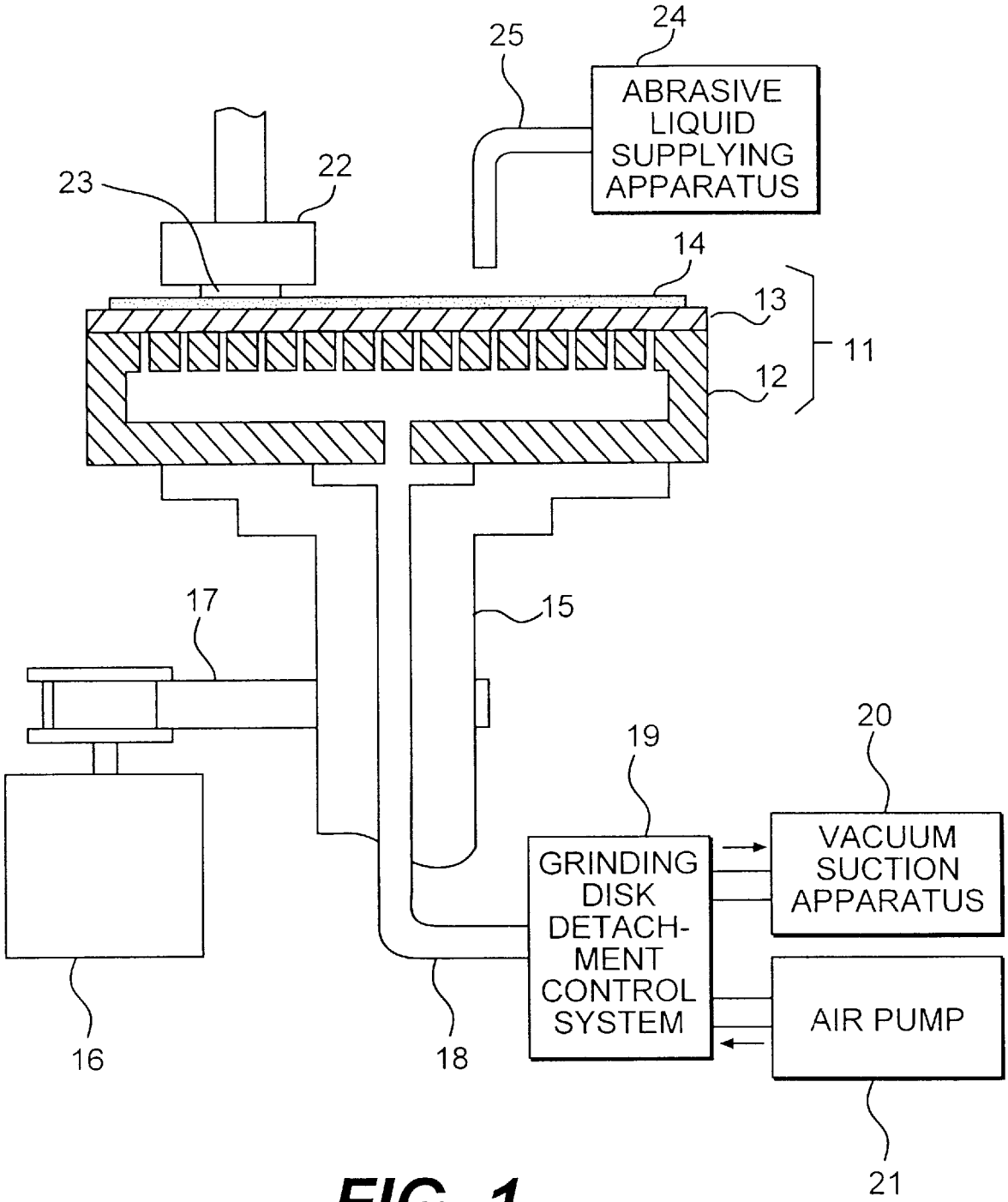
FIG. 1 is a diagrammatical view showing the structure of a grinding apparatus according to one embodiment of the present invention.

FIG. 1 is a diagram showing the structure of a grinding apparatus according to one embodiment of the present invention. In the figure, reference numeral 11 denotes a separation type grinding surface plate, and this separation type grinding surface plate 11 comprises a surface plate body 12 and a disk 13 for grinding. The surface plate body 12, as shown in an enlarged form in FIG. 2, has a vacuum chamber 12*a* provided in it, and many suction ports 12*b* are formed from the vacuum chamber 12*a* to reach the top face.

The disk 13 for grinding having an abrasive cloth 14 affixed to its surface is placed on the surface of the surface plate body 12 with the suction ports 12*a* formed and held on the surface plate body 12 by vacuum suction through the vacuum chamber 12*a* and the suction ports 12*b*. Namely, the disk 13 for grinding is held on the surface plate body 12 by vacuum suction. The vacuum suction here means to suck to a pressure below the atmospheric pressure.

Figure 7:
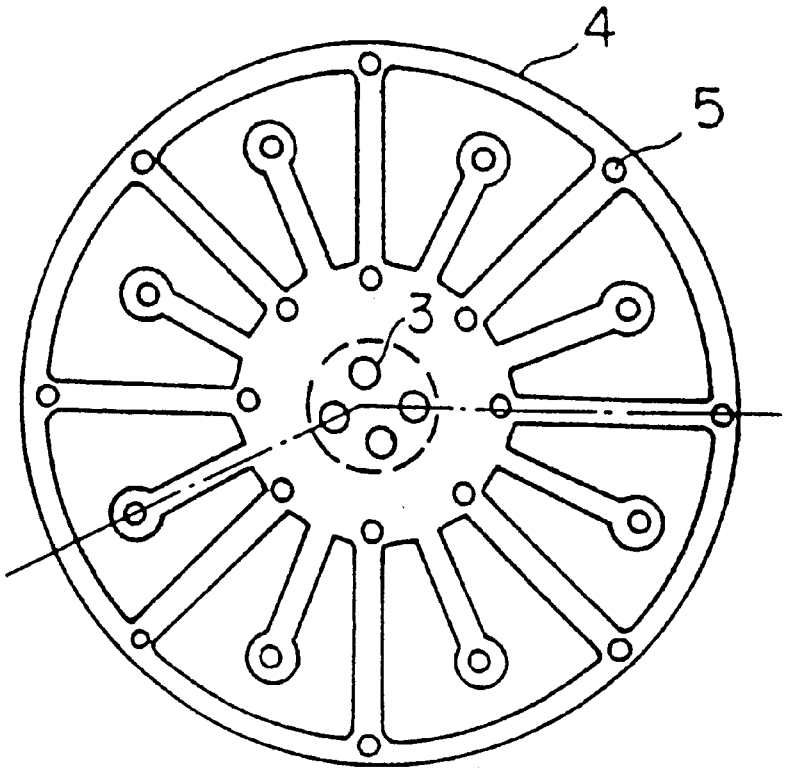
FIG. 7 is a plan view showing a conventional grinding surface plate and a major part of its related grinding apparatus.
Figure 8:
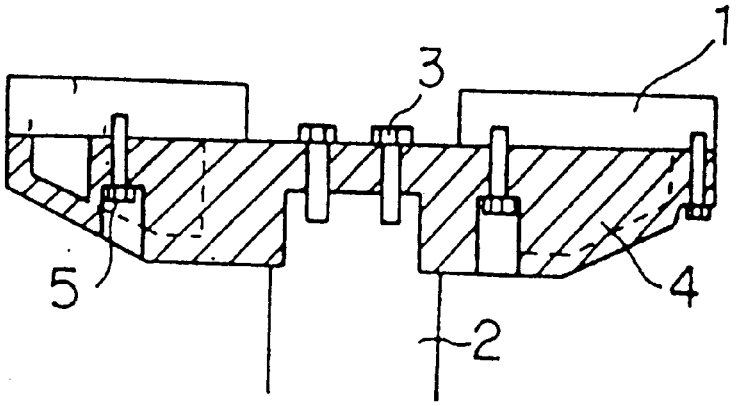
FIG. 8 is a sectional view of the conventional grinding surface plate and grinding apparatus shown in FIG. 7.

A drive shaft 15 is fixed to the bottom face of the surface plate body 12. This drive shaft 15 can also be connected to the surface plate body 12 through the water cooled jacket in the same way as the conventional separation type grinding surface plate as shown in FIG. 7 and FIG. 8. The drive shaft 15 is connected to a motor 16 as a drive system through a drive belt 17, and the separation type grinding surface plate 11 is driven and rotated at a prescribed speed by such drive systems.

A vacuum suction force to hold the disk 13 for grinding on the surface plate body 12 is set to allow the surface plate body 12 and the disk 13 for grinding to rotate together when the separation type grinding surface plate 11 is driven and rotated. And, retaining the integral rotation of the surface plate body 12 and the disk 13 for grinding, the disk 13 for grinding is held on the surface plate body 12 by the vacuum suction force smaller than a stress that a deformation of the disk 13 for grinding in its thickness direction exceeds an allowable range. In other words, the disk 13 for grinding can be held on the surface plate body 12 by the vacuum suction force which allows the displacement in the face direction of the disk 13 for grinding so that the deformation of the disk 13 for grinding in its thickness direction retains the allowable range. By adjusting the vacuum suction force as described above, the disk 13 for grinding can be prevented from the thermal deformation exceeding the allowable range. Here, an allowable deformation of the disk 13 for grinding in its thickness direction varies depending on an accuracy required of an article being ground but be about 800 pm for a silicon wafer and about 500 pm for a pattern-formed wafer for example.

And, by making a hole at the center of the disk 13 for grinding and inserting a fixing pin formed at the center of the surface plate body 12 into the hole to prevent the displacement from the rotation center, holding of the disk 13 for grinding can be supplemented.

A vacuum pipe 18 runs through the above-described drive shaft 15, and the vacuum pipe 18 is connected to a vacuum suction apparatus 20, e.g., a vacuum pump, through a grinding disk detachment control system 19. And, to the grinding disk detachment control system 19, the vacuum suction apparatus 20 and an air pump 21 as a compressed gas supply system which supplies a compressed gas between the surface plate body 12 and the disk 13 for grinding to remove the disk 13 for grinding from the surface plate body 12 are connected.

In the grinding operation, the grinding disk detachment control system 19 is connected to the vacuum suction apparatus 20, and the vacuum suction apparatus 20 is operated. The disk 13 for grinding is held on the surface plate body 12 by being vacuum sucked through the vacuum pipe 18, the vacuum chamber 12*a*, and the suction ports 12*b*. And, to remove the disk 13 for grinding, the grinding disk detachment control system 19 is switched to the air pump 21, and the air pump 21 is operated. The compressed gas supplied from the air pump 21 is blown to the bottom face of the disk 13 for grinding through the vacuum pipe 18, the vacuum chamber 12*a*, and the suction ports 12*b*, so that the disk 13 for grinding is blown upward and can be removed easily.

In the vacuum suction of the disk 13 for grinding, the number and diameter of the suction ports 12*b* on the surface plate body 12 can be appropriately determined to apply a uniform force to the entire disk 13 for grinding and to control the holding power itself. Thus, the integral rotation of the disk 13 for grinding and the surface plate body 12 is achieved, and its holding power against the horizontal direction can be decreased. The specific holding power has been described above. Therefore, even when a difference in thermal expansion is produced between the surface plate body 12 and the disk 13 for grinding due to a difference in temperature gradient or a differential thermal expansion between the surface plate body 12 and the disk 13 for grinding, the disk 13 for grinding can elongate relatively freely in the expansion direction. Thus, by enhancing the freedom of the disk 13 for grinding to elongate in the expansion direction, the disk 13 for grinding can be prevented from being deformed thermally, and the grinding accuracy can be retained. The above-described separation type grinding surface plate 11 is particularly effective for a large surface plate having a diameter exceeding 300 mm.

On the abrasive cloth 14 affixed to the surface of the disk 13 for grinding, an article 23 being ground, e.g., a semiconductor wafer, fixed to a top ring 22 is positioned. And, an abrasive liquid which is a mixed slurry containing abrasive particles and a polishing solution is supplied onto the abrasive cloth 14 from an abrasive liquid supplying apparatus 24 through an abrasive liquid supplying pipe 25. The abrasive liquid supplying apparatus 24 is provided with, e.g., an abrasive liquid tank of which the temperature can be controlled. While supplying the abrasive liquid, the grinding surface plate 11 which has the disk 13 for grinding fixed to the surface plate body 12 by vacuum suction is rotated, and the article 23 being ground which is pushed against the abrasive cloth 14 by a prescribed pressure is rotated and moved on the grinding surface plate 11 while it is being rotated in a direction opposite from that of the grinding surface plate 11. Thus, the grinding operation of the article 23 being ground is performed.

And, when a given number of articles 23 being ground has been ground and the abrasive cloth 14 has to be replaced, the grinding disk detachment control system 19 is switched to the air pump 21, and the air pump 21 is operated as described above to blow up and to remove the disk 13 for grinding. Then, another disk 13 for grinding to which another abrasive cloth 14 has been affixed in advance is mounted on the surface plate body 12 to continue the grinding operation. Thus, in the grinding apparatus according to this embodiment, the abrasive cloth 14 can be replaced in a short time, so that the operation rate of the grinding apparatus is not lowered by the replacing operation of the abrasive cloth 14.

Furthermore, the disk 13 for grinding removed from the grinding apparatus is subjected to the replacement operation of the abrasive cloth 14, and a figuring operation is performed by a separately provided apparatus or the like for figuring the abrasive cloth 14. Thus, by the replacing operation of the abrasive cloth 14 outside of the grinding apparatus, a replacing accuracy of the abrasive cloth 14 and a grinding accuracy are easily retained, and at the same time, since the figuring can be made by the outside arrangement, productivity can be improved.

The disks 13 for grinding in the above-described embodiment is to provide a ground surface, and such disks 13 for grinding are required to have a strength capable of retaining a state that the abrasive cloth is free from wrinkles and stretched out. Besides, they are required to have a strength at a level enough not to be plastically deformed in the detaching operation to the grinding apparatus, the replacing operation of the abrasive cloth 14, the transporting operation or the like. On the other hand, they are required to be lightweight to a level so that a worker can lift with his or her arms stretched horizontally. To meet the above-described lightweight and strength, the material for configuring the disk 13 for grinding preferably have a specific yield strength of 10 Nm/g or more. When the specific yield strength is below 10 Nm/g, wrinkles, deformation or the like is easy to take place in the replacing operation of the abrasive cloth 14 for example.

The accuracy of a ground surface by the disk 13 for grinding is determined by its surface accuracy (plate thickness accuracy) and the surface accuracy of the top face of the surface plate body 12. When the disk 13 for grinding is held on the surface plate body 12 by the above-described vacuum suction, the ground surface accuracy can be attained in the form according to the surface accuracy on the top face of the surface plate body 12, so that the disk 13 for grinding may be deformed within the elastic deformation. Therefore, lightweighting can be made by decreasing the plate thickness depending on the material forming the disk 13 for grinding. But, since a basic surface accuracy has to be determined in advance, it is preferable that the disk 13 for grinding has a plate thickness accuracy of 500 $\mu$m or below and a surface roughness of $R_{max} \leqq 500$ $\mu$m. Here, the plate thickness accuracy of the disk 13 for grinding is determined to be a value measured by an ultrasonic pulse reflection method (JIS Z 2355) for example. The ultrasonic pulse reflection method is a method in that a sound velocity of the material is previously determined and a pulse propagation delay time in the material is converted into a thickness. For example, when a ferrous material has a plate thickness of 6 mm or below, a frequency to be used is 10 to 40 MHz.

When for example a semiconductor wafer is polished, the ground surface has its temperature increased to about 298 to 323 K, causing a temperature gradient between the vicinity of the ground surface and the lower part of the surface plate. For further suppression of the thermal deformation due to the temperature gradient, the configuring material of the disk 13 for grinding is preferred to have a low thermal expansion coefficient. Besides, since a week acid or alkaline solution is generally used as the abrasive liquid, the configuring material of the disk 13 for grinding is preferably corrosion resistant against acid and alkali. This is because, if the disk 13 for grinding is corroded, the article being ground is contaminated by a corrosion product. Furthermore, to control the temperature on the ground surface, the grinding surface plate 11 is forcedly cooled, and in such a case, the configuring material of the disk 13 for grinding is preferably excellent in thermal conductivity.

The configuring material of the disk 13 for grinding is preferably selected considering the above-described fundamental required properties, the required properties in accordance with the application, and the grinding conditions such as an abrasive liquid and a temperature; and various types of materials can be used. For example, for further suppression of the thermal deformation due to a temperature gradient or the like, a low thermal expansion ferrous material containing at least one element selected from Ni and Co, a fiber reinforced composite material or the like is suitable as a configuring material of the disk 13 for grinding. Specific examples of the low thermal expansion ferrous material include an Invar alloy (Fe-36 wt % Ni), a super Invar alloy (Fe-31 wt % Ni-5 wt % Co), and a kovar alloy (Fe-29 wt % Ni-17 wt % Co). The fiber reinforced composite material will be described afterward in detail.

To enhance the corrosion resistance against the abrasive liquid with the above-described strength secured, a corrosion resistant ferrous material or the like containing at least one member selected from Ni and Cr is preferable, and specific examples are stainless steel, Ni steel, Cr steel and the like. Besides, when a conductor to be ground is not allowed to include heavy metal ions such as Fe, Ni, Cr, Co or the like, a light-weight non-ferrous metal such as Al, Mg or Ti, or an alloy thereof is preferable. When importance is placed in cooling with water, a copper-based or aluminum-based high thermal conductive metal or its alloy is preferable. When no metal ion is admissible, a ceramics material of alumina, silicon carbide, zirconia, magnesia, glass or rock, or a fiber reinforced composite material using such a material as matrix can be used. These materials are relatively low thermal expansive.

Furthermore, some surface treatment may be applied effectively to the surface of the disk 13 for grinding made of the above-described metallic material. Specific examples of the surface treatment include film formation such as ceramics coating or fluororesin coating, and diffusion treatment such as carburization, nitriding or thermal diffusion, thereby improving the surface. The above film is used, for example, as a corrosion-resistant film. The film forming method is not limited to a particular one, and can use various types such as a plating method, an ion plating method, a CVD method, and an application method. With the disk 13 for grinding which has a corrosion resistant film formed on the surface of the above-described metallic material, the base metallic material is provided with low thermal expansion characteristics, high toughness, lightweight and other characteristics in addition to the corrosion resistance, enabling to expand its application to extensive use conditions.

Now, the fiber reinforced composite material, one of the configuring materials of the disk 13 for grinding, will be described in detail. The fiber reinforced composite material can provide various characteristics by appropriately selecting a matrix material, and a lightweight, high strength and high rigidity material can be produced according to the type, amount and the like of reinforced fibers. For example, a material which can reduce a weight with high rigidity and high resistance satisfied to retain a dimensional accuracy and a shape accuracy, specifically a material having a specific yield strength of 150 Nm/g or more and a specific Young's modulus of $20\times10^3$ Nm/g or more can be used.

The reinforced fiber in the above fiber reinforced composite material includes carbon fiber, glass fiber, alumina fiber, SiC fiber, SiC whisker, potassium titanate whisker, and aluminum borate whisker. Table 1 shows properties of typical reinforced fibers.

TABLE 1

| | | Density ($\times10^3$ kg/m$^3$) | Diameter ($\mu$m) | Tensile strength (GN/m$^2$) | Elastic modulus (GN/m$^2$) | Thermal expansion coefficient ($\times10^{-6}$/K) |
|---|---|---|---|---|---|---|
| Glass fiber | E glass | 2.55 | 10 | 3.43 | 72 | 4.9 |
| | S glass | 2.50 | 10 | 4.46 | 86 | 4.9 |
| SiC long fiber | | 2.5 | 10 | 2.45 | 176 | 3.1 |
| Carbon fiber | PAN based | 1.75 | 8 | 2.7 | 250 | 0.1 (longitudinal direction) |
| | Pitch based | 1.6 | 12 | 0.7 | 49 | 0.1 (longitudinal direction) |
| Alumina fiber γ-type | | 3.2 | 9 | 2.45 | 245 | 8.8 |
| SiC whisker γ-type | | 3.2 | 1 | 20.6 | 481 | 4.9 |
| Potassium titanate whisker | | 3.58 | 0.3 | 6.84 | 206 | 6.8 |
| Aluminum borate whisker | | 3.0 | 0.3 | 8.0 | 400 | 4.2 |

In the present invention, the fibers shown in Table 1 can be used, but it is particularly desirable to use the carbon fibers which have a low thermal expansion coefficient and a small density. The shape of the reinforced fibers is not particularly restricted, but it is preferable that the long fibers or short fibers has an average diameter of about 3 to 6 $\mu$m, and the whisker has an average diameter of about 0.5 to 2 $\mu$m. And, the combined amount of the reinforced fibers is determined according to the type of the reinforced fibers used or the material of matrix in order to attain required properties.

And, the matrix material of the fiber reinforced composite material includes for example plastic, ceramics containing carbon, and a light alloy such as an aluminum alloy. In particular, it is preferable to use as the matrix material plastic or ceramics which can be formed to be of low thermal expansion. And, when the grinding surface plate 11 is forcedly cooled, it is preferable to use an aluminum alloy or the like excelling in thermal conductivity as the matrix material. Since the aluminum alloy has a high thermal conductivity, its temperature can be controlled easily.

Specific examples of the fiber reinforced composite material using the above-described reinforced fibers and a matrix material include fiber reinforced plastic (particularly, carbon fiber reinforced plastic is effective), fiber reinforced ceramics (particularly, carbon fiber reinforced ceramics is effective), a fiber reinforced aluminum alloy and the like.

For example, the carbon fiber reinforced plastic is produced by placing on a metal mold a prepreg which has a thermosetting resin impregnated to a long carbon fiber fabric, and hot forming by an autoclave or hot pressing. To use as a rotating disk (disk 13 for grinding) in the present invention, it is preferable, for example, to radially overlay lengthwisely and breadthwisely interwoven fiber sheets on a horizontal surface and to give a thermal stress in a radial direction to be almost uniform in all directions.

And, examples of the fiber reinforced ceramics use carbon, silicon nitride, silicon carbide, alumina, or stabilized zirconia as the matrix material. This fiber reinforced ceramics is produced by molding and calcining a mixture of ceramics powder and reinforced fibers according to an ordinary production method. Otherwise, it is also produced by preparing a preform of reinforced fibers, impregnating a ceramics slurry therein, and calcining. In the fiber reinforced ceramics, the carbon fiber reinforced carbon is particularly effective. And, when this fiber reinforced ceramics is used to form the disc 13 for grinding, it is preferable to apply Ni plating or fluororesin coating to its surface, thereby capable of improving the corrosion resistance. And, as the method for producing the fiber reinforced light alloy, a molten metal impregnating method, a power metallurgy method, a hot press method or the like can be applied.

The disk 13 for grinding and the surface plate body 12 are preferably structured to have the equivalent thermal expansion when grinding. For example, in the case of a surface plate having a diameter of 600 mm, a difference in thermal expansion when grinding is desired to fall in a range of 1 to 5 $\mu$m. This is to prevent more effectively the thermal deformation due to a difference in thermal expansion between the disk 13 for grinding and the surface plate body 12. The above-described structure can be achieved by selecting a configuring material to make, for example, the disk 13 for grinding and the surface plate body 12 have the equivalent thermal expansion coefficient (in connection with the temperature when grinding), or by controlling the temperature of the surface plate body 12 for example. As the specific configuring material of the surface plate body 12, a low expansion cast iron similar to the one for the ordinary grinding surface plate may be used, and a material same as the cast 13 for grinding can also be used.

Now, the specific examples and the evaluated results of the embodiment described above will be described.

EXAMPLE 1

First, polyacrylonitrile (PAN) based high-rigidity long fibers having a fiber diameter of 8.5 $\mu$m were arranged horizontally in multiple numbers, and a thermosetting resin, epoxy resin, was impregnated into them to prepare 60 sheets (prepreg, thickness=0.2 mm) of 700×700 mm.

Then, these sheets were overlaid one another with the centers of respective sheets aligned and a fiber direction displaced by 72° so that the orientation of fibers in the radial direction become uniform. The overlaid article was mounted on a disk-shaped metal mold having a high accuracy in flatness, thermally formed in an autoclave under setting conditions of a temperature of 403 K, a pressure of 0.5 MPa for 90 minutes to produce a disk 13 for grinding made of carbon fiber reinforced plastic (CFRP) and having a diameter of 600 mm, a thickness of about 10 mm and a weight of 5 kg.

This CFRP disk 13 for grinding had a carbon fiber volume ratio of about 40%, and a thermal expansion coefficient (room temperature to 373 K) of $9.0\times10^{-6}$/K. And, it had a density of $1.6\times10^{3}$ kg/m$^3$, a yield strength of 1.4 GN/m$^2$, a Young's modulus of 220 GN/m$^2$, a specific yield strength of 875 Nm/g, and a specific Young's modulus of $137.5\times10^{3}$ Nm/g. And, an abrasive cloth 14 was affixed to the CFRP disk 13 for grinding.

On the other hand, a surface plate body 12 having a diameter of 600 mm was produced of a low expansion cast iron (material equivalent to FCDLE4 of JIS G5511) having a thermal expansion coefficient of about $8.5\times10^{-6}$/K at 288 to 323 K, and its top surface was finished to flatness of 2 $\mu$m or below. And, this top surface had a total of 50 vacuum suction ports 12*b* with a diameter of 2 mm formed by drilling.

Figure 2:
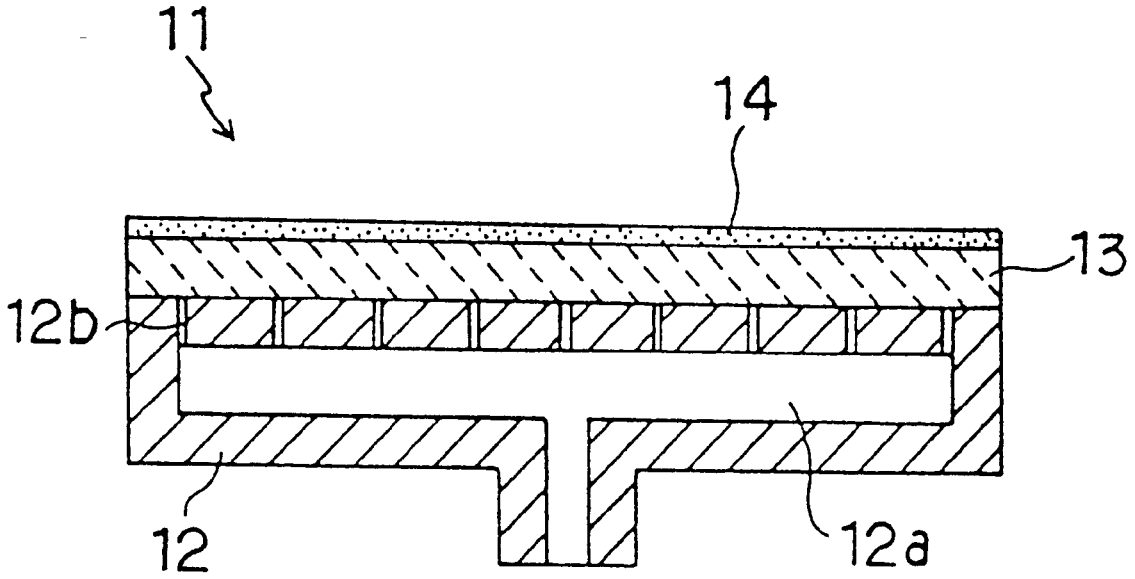
FIG. 2 is a sectional view showing a separation type grinding surface plate in an expanded size for the grinding apparatus shown in FIG. 1.

Using the CFRP disk 13 for grinding and the low expansion cast iron surface plate body 12 prepared above, the separation type grinding surface plate 11 shown in FIG. 2 was configured and mounted on the grinding apparatus shown in FIG. 1. The CFRP disk 13 for grinding was fixed to the low expansion cast iron surface plate body 12 by vacuum suction. At this time, the vacuum suction force was as described above, but the vacuum suction was specifically made at 0.9 atmospheric pressure.

By using the above-described separation type grinding surface plate 11, the CFRP disk 13 for grinding can be detached easily from the surface plate body 12, and the disk 13 for grinding can be readily carried because it is lightweight. Therefore, the replacing operation of the abrasive cloth 14 can be performed with the disk 13 for grinding removed from the grinding apparatus. Besides, the replacing operation of the abrasive cloth 14 can be performed as an outside arrangement outside of the grinding work environment, for example, outside of a clean room. Thus, the affixing accuracy of the abrasive cloth 14 can be secured easily, the number of manhours for replacing it can be decreased, and the grinding work environment such as a clean room can be prevented from being polluted. And, since the replacing operation of the abrasive cloth 14 and others can be made by the outside arrangement, the operation rate of the grinding apparatus can be improved.

And, when the grinding apparatus having the above-described separation type grinding surface plate 11 was used to actually grind a semiconductor wafer having a diameter of 6 inches, the shape accuracy was not degraded because the CFRP disk 13 for grinding was highly rigid. Besides, since the CFRP disk 13 for grinding was tightly fixed to the surface plate body 12 by an appropriate vacuum suction force, the flatness of the disk 13 for grinding followed the surface plate body 12 to provide good flatness. In addition, since the CFRP disk 13 for grinding and the surface plate body 12 had almost the equivalent thermal expansion, thermal deformation did not take place by the grinding heat. Accordingly, remarkable polishing could be realized.

Such effects were noticeably obtained as the semiconductor wafer had a larger diameter and confirmed to be very effective to provide a large semiconductor wafer.

EXAMPLE 2

Fabrics (100×100×0.2 mm thick) woven from 1000 filaments of PAN based carbon short fibers were overlaid in the same way as in Example 1 by using colloidal silica as a binder to produce a preform having a short carbon fiber volume ratio of 30%, a diameter of 600 mm and a height of 8 mm. Using a molten metal forging machine, the above preform was placed in a metal mold, and ADC12 aluminum alloy was impregnated under conditions of a molten metal temperature of 1073 K and a pressure of 80 MPa to produce a carbon fiber reinforced aluminum alloy disk 13 for grinding having the same shape as the one in Example 1.

The above carbon fiber reinforced aluminum alloy disk 13 for grinding had a thermal expansion coefficient (room temperature to 373 K) of $18\times10^{-6}$/K, a density of $2.2\times10^{3}$ kg/m$^3$, a yield strength of 1.0 GN/m$^2$, a Young's modulus of 160 GN/m$^2$, a specific yield strength of 454.5 Nm/g, and a specific Young's modulus of $72.7\times10^{3}$ Nm/g; and the disk 13 for grading had a weight of about 5 kg.

On the other hand, SUS316 stainless steel was used to produce a surface plate body 12 having the same size as the one in Example 1. The SUS316 surface plate body 12 had a thermal expansion coefficient of $16\times10^{-6}$/K at about room temperature.

The above-described carbon fiber reinforced aluminum alloy disk 13 for grinding and the SUS316 surface plate body 12 were used to configure the separation type grinding surface plate 11 in the same way as in Example 1. By using this separation type grinding surface plate 11, a good grinding operation with the thermal deformation prevented could be achieved in the same way as in Example 1. And, the removal and carrying operations of the disk 13 for grinding and the replacing operation of the abrasive cloth 14 could be performed easily, and the grinding work environment such as a clean room could be prevented from being polluted.

EXAMPLE 3

Using carbon fiber reinforced carbon containing carbon fibers with a volume ratio of 40%, a disk 13 for grinding having the same size as the one in Example 1 was produced, and Ni coating having a thickness of about 30 $\mu$m was applied onto its surface by a vacuum deposition method. With this Ni coating, penetration of the abrasive liquid and occurrence of particles from the carbon fiber reinforced carbon can be prevented even when the carbon fiber reinforced carbon is somewhat porous.

The above carbon fiber reinforced carbon disk 13 for grinding had a thermal expansion coefficient (room temperature to 373 K) of $0.5\times10^{-6}$/K, a density of $1.76\times10^{3}$ kg/m$^3$, a yield strength of 2.0 GN/m$^2$, a Young's modulus of 150 GN/m$^2$, a specific yield strength of $1.1\times10^{3}$ Nm/g, and a specific Young's modulus of $85\times10^{3}$ Nm/g; and the disk for grading had a weight of about 5 kg.

On the other hand, low expansion cast steel having a thermal expansion coefficient of about $0.5\times10^{-6}$/K at about room temperature was used to produce a surface plate body 12 having the same size as the one in Example 1.

The above-described carbon fiber reinforced carbon disk 13 for grinding and the low expansion cast steel surface plate body 12 were used to configure the separation type grinding surface plate 11 in the same way as in Example 1. By using this separation type grinding surface plate 11, a good grinding operation with the thermal deformation prevented could be achieved in the same way as in Example 1. And, the removal and carrying operations of the disk 13 for grinding and the replacing operation of the abrasive cloth 14 could be performed easily, and the grinding work environment such as a clean room could be prevented from being polluted.

EXAMPLE 4

First, PAN based carbon short fibers (a diameter of about 7 $\mu$m, a length of about 50 to 100 $\mu$m) and $Si_3N_4$ powder (average particle diameter of about 8 $\mu$m) were mixed at a volume ratio of 1:2. Then, a sintering auxiliary and water were added thereto to make it slurry and mixed in an alumina ball mill for 48 hours. -The slurry was flowed into a plaster mold to make a green compact. Then, the green compact was calcined in nitrogen gas at 1923 K, and machined to produce a disk 13 for grinding having a diameter of 600 mm and a height of 8 mm.

The above carbon fiber reinforced ceramics disk 13 for grinding had a thermal expansion coefficient (room temperature to 373 K) of $3.0\times10^{-6}$/K, a density of $2.2\times10^{3}$ kg/m$^3$, a bending yield strength of 5 GN/m$^2$, a Young's modulus of 200 GN/m$^2$, a specific yield strength of $2.3\times10^{3}$ Nm/g, and a specific Young's modulus of $91\times10^{3}$ Nm/g; and the disk for grading had a weight of 5.2 kg.

On the other hand, low expansion cast iron having a thermal expansion coefficient of about 2.0 to $2.5\times10^{-6}$/K at about room temperature was used to produce a surface plate body 12 having the same size as the one in Example 1.

The above-described carbon fiber reinforced ceramics disk 13 for grinding and the low expansion cast steel surface plate body 12 were used to configure the separation type grinding surface plate 11 in the same way as in Example 1. By using this separation type grinding surface plate 11, a good grinding operation with the thermal deformation prevented could be achieved in the same way as in Example 1. And, the removal and carrying operations of the disk 13 for grinding and the replacing operation of the abrasive cloth 14 could be performed easily, and the grinding work environment such as a clean room could be prevented from being polluted.

EXAMPLES 5 TO 10

As the configuring materials of the disks 13 for grinding, stainless steel SUS 316L (Example 5), Invar alloy Fe-36 wt % Ni (Example 6), titanium alloy Ti-6 wt % Al-4 wt % V (Example 7), aluminum alloy 2014Al (Example 8), alumina (Example 9), and copper (Example 10) were prepared, and the disks 13 for grinding having the same shape as in Example 1 were produced respectively. The respective disks 13 for grinding had a thickness accuracy of 500 gm or below, and a surface roughness ($R_{max}$) of 50 $\mu$m or below.

Example 5 is effective when an abrasive liquid which is for example strong acid with a pH of about 2 to 3 (e.g., nitric acid based abrasive liquid) is used, for example, when an aluminum based material or the like is insufficient in corrosion resistance. And, stainless steel SUS 316L was also used as the material for the surface plate body 12. Even when grinding heat becomes high to 303 to 353 K, corrosion does not progress because a passive state film is formed on the surface of the disk 13 for grinding. Using the above stainless steel disk 13 for grinding and the stainless steel surface plate body 12, the separation type grinding surface plate 11 was configured in the same way as in Example 1.

Example 6 is effective when the thermal deformation is required to be reduced further in the same way as in Example 1. For the configuring material of the surface plate body 12, a low expansion cast iron having a thermal expansion coefficient of $1.1\times10^{-6}$/K almost the same as the Invar alloy in a temperature range of room temperature to 373 K was used. Main ingredients of this low expansion cast iron are C 1.1%-Si 0.2%-Mn 0.2%-Ni 30%-Co 5%-Mg 0.03% (wt %). These materials are iron alloys containing 25 wt % or more of Ni and has a sufficient corrosion resistance even when the abrasive liquid is alkaline or acid such as hydrochloric acid based or nitric acid based. Using the Invar disk 13 for grinding and the low expansion cast iron surface plate body 12, the separation type grinding surface plate 11 was configured in the same way as in Example 1.

Example 7 is effective for corrosion resistance and lightweight. Example 8 is effective to provide lightweight and high strength. Example 9 is effective for corrosion resistance, lightweight, and low thermal expansion to some extent. Besides, Example 10 is effective to provide good thermal conductivity. As to the above cases, the disk 13 for grinding and respective surface plate bodies 12 of which the materials are shown in Table 2 were used to configure the separation type grinding surface plates 11 in the same way as in Example 1.

The above-described each separation type grinding surface plate 11 was mounted on the grinding apparatus shown in FIG. 1 in the same way as in Example 1 to operate the grinding of a semiconductor wafer, and every disk 13 for grinding could prevent the thermal deformation and achieve a good grinding operation.

EXAMPLE 11

In the same way as in Example 6, a chromium oxide dense film having a thickness of about 1 to 2 $\mu$m was formed on respective surfaces of the disk 13 for grinding made of the Invar alloy and the surface plate body 12 made of the low expansion cast iron. The chromium oxide ($Cr_2O_3$) film was formed by immersing the above respective parts in an aqueous solution containing 60% of $CrO_3$ and calcining at a temperature of 773 to 873 K. To provide a thickness of 1 to 2 $\mu$m, the above immersing and calcining procedures may be repeated several times. Using the above $Cr_2O_3$ film-formed disk 13 for grinding and surface plate body 12, the separation type grinding surface plate 11 was configured in the same way as in Example 1. This separation type grinding surface plate 11 was mounted on the grinding apparatus shown in FIG. 1 in the same way as in Example 1 to operate the grinding of a semiconductor wafer, and every disk 13 for grinding could prevent the thermal deformation and achieve a good grinding operation. And, sufficient corrosion resistance could be secured against a quite corrosive abrasive liquid such as a nitric acid based abrasive liquid at 333 to 343 K.

Table 2 shows various characteristics of the configuring materials for respective disks for grinding according to Examples 1 to 11.

TABLE 2

| Example | 1 | 2 | 3 | 4 | 5 | 6 |
|---|---|---|---|---|---|---|
| Material for grinding disk | CFRP | CF/Al alloy | CF/C | CF/ Si3N4 | SUS316L | Invar |
| Thermal expansion coefficient (RT-373K) ($\times 10^{-6}$/K) | 9 | 18 | 0.5 | 3.0 | 18 | 1.5 |
| Thermal conductivity (W/m K) | 0.1 | 110 | 1.0 | 1.0 | 15 | 15 |
| Density ($\times 10^3$ kg/m$^3$) | 1.6 | 2.2 | 1.76 | 2.2 | 7.9 | 8.0 |
| Specific yield strength (Nm/g) | 875 | 454.5 | 1100 | 2300 | 38 | 38 |
| Characteristics of grinding disk | Low thermal expansion elasticity | | lightweight high | | Corrosion resistance | Low thermal expansion |
| Surface plate body material | Low expansion cast iron | SUS316L | Low expansion cast iron | Low expansion cast iron | SUS316L | Low expansion cast iron |
| Thermal expansion coefficient of surface plate body ($\times 10^{-6}$/K) | 9 | 16 | 0.5 | 2.0~2.5 | 18 | 1.5 |

| Example | 7 | 8 | 9 | 10 | 11 |
|---|---|---|---|---|---|
| Material for grinding disk | 6Al-4V-Ti alloy | 2014Al alloy | Almina | Copper | Invar/Cr2O3* |
| Thermal expansion coefficient (RT-373K) ($\times 10^{-6}$/K) | 9 | 23 | 8 | 20 | 1.5 |
| Thermal conductivity (W/m K) | 10 | 123 | 20 | 395 | 15 |
| Density ($\times 10^3$ kg/m$^3$) | 4.4 | 2.8 | 3.7 | 8.9 | 8.0 |
| Specific yield strength (Nm/g) | 189 | 143 | 100 | 39 | 38 |
| Characteristics of grinding disk | Light weight corrosion resistance | Light metal | Low expansion/ corrosion resistance | Thermal conductivity | Low expansion/ corrosion resistance |
| Surface plate body material | Low expansion cast iron | AC4CAl alloy | Low expantion cast iron/ Teflon* | Copper | Low expansion cast iron/ Cr2O3* |
| Thermal expansion coefficient of surface plate body ($\times 10^{-6}$/K) | 9 | 23 | 8 | 20 | 1.5 |

*: coating

EXAMPLE 12

Using Inval alloy (Fe-36wt % Ni), the electromagnetic attraction disk 13 for grinding And the surface plate body 12 with the electromagnets 25 embedded shown in FIG. 5 were produced. The disk 13 for grinding was determined to have a thickness accuracy of 500 $\mu$m or below and a surface roughness (Rmax) 50 $\mu$m or below.

The above Invar disk 13 for grinding and the Invar surface plate body 12 were used to produce the separation type grinding surface plate 26 based on the electromagnetic force as shown in FIG. 5. This separation type grinding surface plate 26 was mounted on the grinding apparatus shown in FIG. 5 to perform the grinding operation of a semiconductor wafer in the same way as in Example 1, and the good grinding operation could be performed without thermally deforming the Invar disk 13 for grinding.

By the above-described separation type grinding surface plate 26, the Invar disk 13 for grinding could be fixed or released easily as desired by opening or closing of a DC power source to the electromagnets 25 or rotating magnetic poles. And, since a stress by the thermal expansion or grinding can be released by determining an attraction force to an appropriate magnetic force of about 0.5 MPa, the Invar disk 13 for grinding could be prevented from being deformed.

EXAMPLE 13

Nonmagnetic austenite based stainless steel SUS 316 was used to produce the disk 13 for grinding, and ferromagnetic cast iron was used to produce the surface plate body 12 as Shown in FIG. 6. And, the periphery fixing jig 29 was produced by attaching the SmCo based magnet 28 to the supporting ring 27. They were used to configure the separation type grinding surface plate 26 based on the electromagnetic force as shown in FIG. 6. Specifically, the stainless steel disk 13 for grinding was mounted on the cast iron surface plate body 12, the periphery fixing jig 29 was further positioned on it, and the stainless steel disk 13 for grinding was fixed by the magnetic force of the periphery fixing jig 29.

This separation type grinding surface plate 26 was mounted on the grinding apparatus shown in FIG. 6 to perform the grinding operation of a semiconductor wafer in the same is way as in Example 1, and the good grinding operation could be performed without thermally deforming the stainless steal disk 13 for grinding.

COMPARATIVE EXAMPLE 1

Stainless steel SUS 316L was used to produce a disk for grinding and a surface plate body having the same size with those in Example 1. This disk for grinding and the surface plate body were fixed by tightening bolts at eight positions on the outer circumference of the disk for grinding. This grinding surface plate was mounted on the grinding apparatus in the same way as in Example 1 to perform the grinding operation of a semiconductor wafer, and the grinding temperature increased to 313 K. At this time, the surface of the disk for grinding had a temperature of 313 K, but the surface place body had a temperature of 303 K, indicating the production of a temperature gradient between the disk tor grinding and the surface plate body. Therefore, it was observed that the periphery of the center of the disk for grinding was deformed to protrude because the disk for grinding had a higher thermal expansion than the surface plate body. As a result, the flatness of the semiconductor wafer was greatly degraded.

It is apparent from Comparative Example 1 that when the disk for grinding and the surface plate body were partly fixed mechanically by means of bolts, thermal expansion is restricted, the residual distortion is released and a rotating stress due to friction at grinding is concentrated on the fixed parts, so that the disk for grinding is deformed, degrading the grinding accuracy. On the other hand, in the holding mechanism by the vacuum suction or magnetic force according to the present invention, such stresses are not restricted, so that the disk for grinding is kept in a state pushed against the surface plate body. In other words, a good surface accuracy is retained, and a remarkable grinding accuracy can be obtained.

INDUSTRIAL APPLICABILITY

As described above, the separation typo grinding surface plate of the present invention has a structure that the disk for grinding serving as the grinding surface which is subject to the management work can be readily detached and carried, and held on the surface plate body by vacuum suction which can prevent the thermal deformation. Therefore, while keeping a good grinding accuracy, an accuracy can be secured and a labor can be saved in the surface plate cleaning and the replacement of the abrasive cloth. And, the grinding apparatus according to the present invention using the above separation type grinding surface plate can improve both the grinding accuracy and the apparatus operation rate. Therefore, the grinding apparatus according to the present invention is useful for the accurate grinding of semiconductor wafers, prisms and the like.

I claim:

1. A separation type of surface plate for grinding or polishing, comprising:

a surface plate body configured to be connected to a drive of a grinding or polishing apparatus, said surface plate body having a plurality of suction ports dispersed on an entire surface of said surface plate body;

a disk for grinding or polishing a semiconductor wafer on said surface plate body, said disk being rotatable with said surface plate body, the surface plate body and the disk having a different thermal expansion; and means for detachably holding said disk on said surface plate body by substantially uniform suction force applied through said suction ports so that said semiconductor wafer is capable of being placed in contact with said disk directly or indirectly through an abrasive cloth, the suction force applied by the holding means being selected so that said disk is held while thermal expansion of the disk occurs in a face direction of said disk without deformation of the disk in a thickness direction of said disk, the suction force applied by the holding means maintaining surface accuracy of the disk.

2. The separation type surface plate according to claim 1, wherein the suction force holding said disk on said surface plate body is smaller than a force required to deform said disk in a thickness direction of said risk.

3. The separation type surface plate according to claim 1, wherein said suction ports are substantially uniformly formed in multiple numbers in said surface plate body.

4. The separation type surface plate according to claim 1, wherein said disk is made of a low expansion iron based material containing at least one member selected from Ni and Co.

5. The separation type surface plate according to claim 1, wherein said disk is made of a corrosion resistant iron based material containing at least one member selected from Ni and Cr.

6. The separation type surface plate according to claim 1, wherein said disk is made of a lightweight non-ferrous metallic material.

7. The separation type surface plate according to claim 1, wherein said disk is made of a copper based or aluminum based high thermal conductive metallic material.

8. The separation type surface plate according to claim 1, wherein said disk is made of a fiber reinforced composite material.

9. The separation type surface plate according to claim 1, wherein said disk and said surface plate body are configured to have the equivalent thermal expansion during grinding.

10. The separation type surface plate according to claim 1, wherein said disk has a hole formed at a center of said disk, and wherein said plate further comprises a fixing pin passing through a center of said surface plate body and being inserted into said hole.

11. An apparatus for grinding or polishing, comprising:

a separation type surface plate comprising a surface plate body having a plurality of suction ports dispersed on an entire surface of said surface plate body, and a disk for grinding or polishing a semiconductor wafer on said surface plate body, said disk being rotatable with said surface plate body and being detachably held on said surface plate body by suction applied through said suction ports, the surface plate body and the disk having a different thermal expansion;

vacuum means for holding said disk on said surface plate body by applying a substantially uniform suction force to said disk through said suction ports, the suction force applied by the vacuum means being selected so that the disk is held while thermal expansion of the disk occurs in a face direction of said disk without deformation of the disk in a thickness direction-of said disk, the suction force applied by the vacuum means maintaining surface accuracy of the disk;

a drive system comprising a drive shaft connected to said surface plate body, said drive system rotating said separation type surface plate to drive said separation type surface plate; and abrasive liquid supplying means for supplying an abrasive liquid on said disk.

12. The apparatus according to claim 11, wherein the suction force applied by said vacuum system is smaller than a force required to deform said disk in a thickness direction of said disk.

13. The apparatus according to claim 11, further comprising a compressed gas supply system for supplying compressed gas between said surface plate body and said disk to remove said disk from said surface body plate.

14. The apparatus according to claim 11, wherein said disk has a hole formed at a center of said disk, and wherein said plate further comprises a fixing pin passing through a center of said surface plate body and being inserted into said hole.

15. A method for grinding or polishing a semiconductor wafer, comprising:

placing a grinding or polishing disk on a surface plate body having a plurality of suction ports dispersed on an entire surface of said surface plate body, said disk being rotatably with said surface plate body, the surface plate body and the disk having a different thermal expansion;

holding said disk detachably on said surface plate body with a substantially uniform suction force applied through said suction ports, the suction force being selected so that the disk is held while thermal expansion of the disk occurs in a face direction of said disk without deformation of the disk in a thickness direction of said disk, the suction force maintaining surface accuracy of the disk;

placing said semiconductor wafer in contact with said disk directly or indirectly through an abrasive cloth; and grinding or polishing said semiconductor wafer by rotating said surface plate body with said disk and by supplying an abrasive liquid on said disk.

* * * * *

UNITED STATES PATENT AND TRADEMARK OFFICE

CERTIFICATE OF CORRECTION

PATENT NO.: 6,083,083

DATED: July 4, 2000

INVENTOR(S): Nishimura

It is certified that an error appears in the above-identified patent and that said Letters Patent is hereby corrected as shown below:

Claim 2, column 16, line 56, delete "risk" and insert --disk--.

Claim 11, column 17, line 35, delete "direction-of" and insert --direction of--.

Signed and Sealed this

Eighth Day of May, 2001

*Attest:*

Nicholas P. Godici

NICHOLAS P. GODICI

*Attesting Officer*

*Acting Director of the United States Patent and Trademark Office*